US005328659A

United States Patent [19]

Tillman et al.

[11] Patent Number: 5,328,659

[45] Date of Patent: Jul. 12, 1994

[54] SUPERALLOY HEAT TREATMENT FOR PROMOTING CRACK GROWTH RESISTANCE

[75] Inventors: Thomas D. Tillman; John M. Robertson; Arthur R. Cox, all of Jupiter, Fla.

[73] Assignee: United Technologies Corporation, Hartford, Conn.

[21] Appl. No.: 733,446

[22] Filed: May 10, 1985

Related U.S. Application Data

[63] Continuation-in-part of Ser. No. 434,654, Oct. 15, 1982, abandoned.

[51] Int. Cl.[5] ..... C22C 19/05

[52] U.S. Cl. ..... 420/448; 148/410; 148/675

[58] Field of Search ..... 420/446, 447, 448, 449, 420/450; 148/133, 162, 675, 410, 555

[56] References Cited

U.S. PATENT DOCUMENTS

| | | | |
|---|---|---|---|
| 3,653,987 | 4/1972 | Boesch | 148/162 |
| 3,677,830 | 7/1972 | Cox et al. | 148/12.7 |
| 4,116,723 | 9/1978 | Gell et al. | 148/162 |
| 4,253,884 | 3/1987 | Maurer et al. | 148/162 |
| 4,459,160 | 7/1984 | Meetham et al. | 148/162 |
| 4,512,817 | 4/1985 | Duhl et al. | 148/162 |
| 4,574,015 | 3/1986 | Genereux et al. | 148/162 |
| 4,579,602 | 4/1986 | Paulonis et al. | 148/11.5 |

OTHER PUBLICATIONS

Processing Effects on Microstructure and Fatigue Properties of Nickel-Base Superalloys (Prepared Under Naval Air Systems Command-Contract No. N00019-7-9-C-0659) by R. H. Van Stone et al.-Dec. 1980.

The Effects of Microstructure on Elevated Temperature Crack Growth in Nickel-Base Superalloys, by H. F. Merrick et al., Metallurgical Transactions, Feb. 1978.

Metallurgical Factors Affecting the Crack Growth Resistance of a Superalloy by J. M. Larson et al., Metallurgical Transactions, Jan. 1977.

*Primary Examiner*—Donald P. Walsh
*Assistant Examiner*—Ngoclan T. Mai
*Attorney, Agent, or Firm*—Chalres E. Sohl

[57] ABSTRACT

Nickel base superalloy articles, especially gas turbine disks, are provided with substantially enhanced resistance to crack growth through a specific heat treatment. The heat treatment employs a true solution treatment step followed by a subsolvus solution treatment step, followed by at least one aging step. The effect of this series of heat treatment steps is to provide a microstructure having an optimum arrangement of gamma prime particles, with respect to both size and location. Reductions in crack growth rates of several hundred percent relative to prior art heat treatments are achieved.

7 Claims, 3 Drawing Sheets

SUPERALLOY HEAT TREATMENT FOR PROMOTING CRACK GROWTH RESISTANCE

This is a continuation-in-part application of U.S. Ser. No. 434,654, filed Oct. 15, 1982, now abandoned.

TECHNICAL FIELD

This invention relates to the heat treatment of superalloy articles.

BACKGROUND ART

Extensive use of superalloys is made in gas turbine engines. Superalloy components in gas turbine engines operate near the limit of their properties in a severe environment, both with respect to temperature, stress and oxidation/corrosion. One of the major classes of components in a gas turbine engine are the disks upon the periphery of which is mounted a plurality of blades. The disks rotate at speeds on the order of 8,000 to 10,000 rpm and, in the turbine section of the engine, can be exposed to temperatures on the order of 1000° F. to 1300° F. (538° C. to 704° C.). During engine operation, the disks are exposed to cyclic stress conditions which can lead to failure. Every effort is made to increase the rotational speed of the engine, since by increasing engine rotational speed, increased thrust and fuel efficiency can be obtained. Counterbalancing this effort, however, is the appreciation that catastrophic disk failure cannot be tolerated. Periodic exhaustive engine inspections are made and a particular item of concern in such inspection is the possible presence of cracks in disks.

Thus, there exists a need for a disk material capable of withstanding more demanding stress conditions without catastrophic failure, and there exists a need for disk material which will not fail catastrophically, but rather will fail by slow, steady, progressive crack growth, crack growth at a rate slow enough that periodic engine inspections will uncover such cracks well before catastrophic failure can occur.

It is now appreciated that in virtually every metallic article, flaws exist; it is merely a matter of looking for the flaws on a fine enough scale—existing flaws will initiate cracks. It is believed that cracks in disks, as in most other metallic articles, originate at flaws in the material and grow in response to engine stress conditions. The object then is to have the cracks which do form grow at a slow rate, that is to say, da/dn should be minimized (where a is crack length and n is the number of stress cycles). At the same time, however, the minimization of the da/dn characteristic of the material must be accomplished without significant detriment to the other important mechanical properties of the material including creep, stress rupture, fatigue and the like.

Prior art heat treatments for disk materials have generally included what is referred to as a solution treatment step, followed by several aging steps performed at lower temperatures. In fact, however, the prior art has generally used a "solution treatment" performed below the true solution temperature of the alloy. Through the use of such a step, the gamma prime phase is not totally taken in solution; but instead, sufficient gamma prime remains to minimize grain growth. Thus, the fine grain size of the starting material is not substantially affected by the solution treatment temperature. In the prior art, it was generally believed that the maintenance of a fine grain size was essential to the achievement of desirable disk properties.

We have found, however, that a different approach to heat treatment can provide substantially improved mechanical properties. Therefore, it is an object of this invention to describe a heat treatment which can be applied to nickel base superalloy articles and which will significantly reduce the rate at which cracks grow without materially reducing other important mechanical properties.

DISCLOSURE OF INVENTION

The present invention concerns a heat treatment which can be applied to nickel base superalloy articles to provide enhanced resistance to crack growth at intermediate temperatures. A particular nickel base superalloy article to which the present invention can advantageously be applied, is the disks employed in the turbine section of gas turbine engines. Such disks are commonly made of superalloys, including the IN-100, Rene 95 and Astroloy compositions (these compositions are presented in Table I). In modern high performance turbine engines, the disks are commonly made by one of several techniques which employs powder metallurgy in the early steps of processing. It is however, believed that the present invention would be equally applicable to forged disks produced starting from castings.

The first step in the heat treatment process is a solution treatment, a true solution treatment performed at a temperature between the gamma prime solvus and the incipient melting temperature. This step is performed at a temperature where complete dissolution of the gamma prime phase occurs, so that grain growth does occur. The solution treatment step can extend from about 1 to about 10 hours, however, times on the order of from 1 to 4 hours are preferred in the case of the powder metallurgy derived disks. Following the solution treatment step, the disk is slow cooled to a temperature somewhat below the gamma prime solvus temperature. Once the article is cooled to the desired temperature below the gamma prime solvus, it can subsequently be cooled to room temperature at a faster rate. The disk is then solution treated at a temperature below, but near the gamma prime solvus, and fast cooled. Following this cooling step, the article is then aged using at least one aging treatment at an intermediate temperature. This aging treatment may preferably be performed at more than one temperature in which case the temperatures are preferably arranged in an increasing order. Preferably, at least one of the aging temperatures equals or exceeds the maximum anticipated use temperature which the disk will encounter in service.

The foregoing, and other features and advantages of the present invention, will become more apparent from the following description and accompanying drawing.

and assuming a surface flaw of 0.012×0.024 inch (0.030×0.061 cm).

Figure 2:
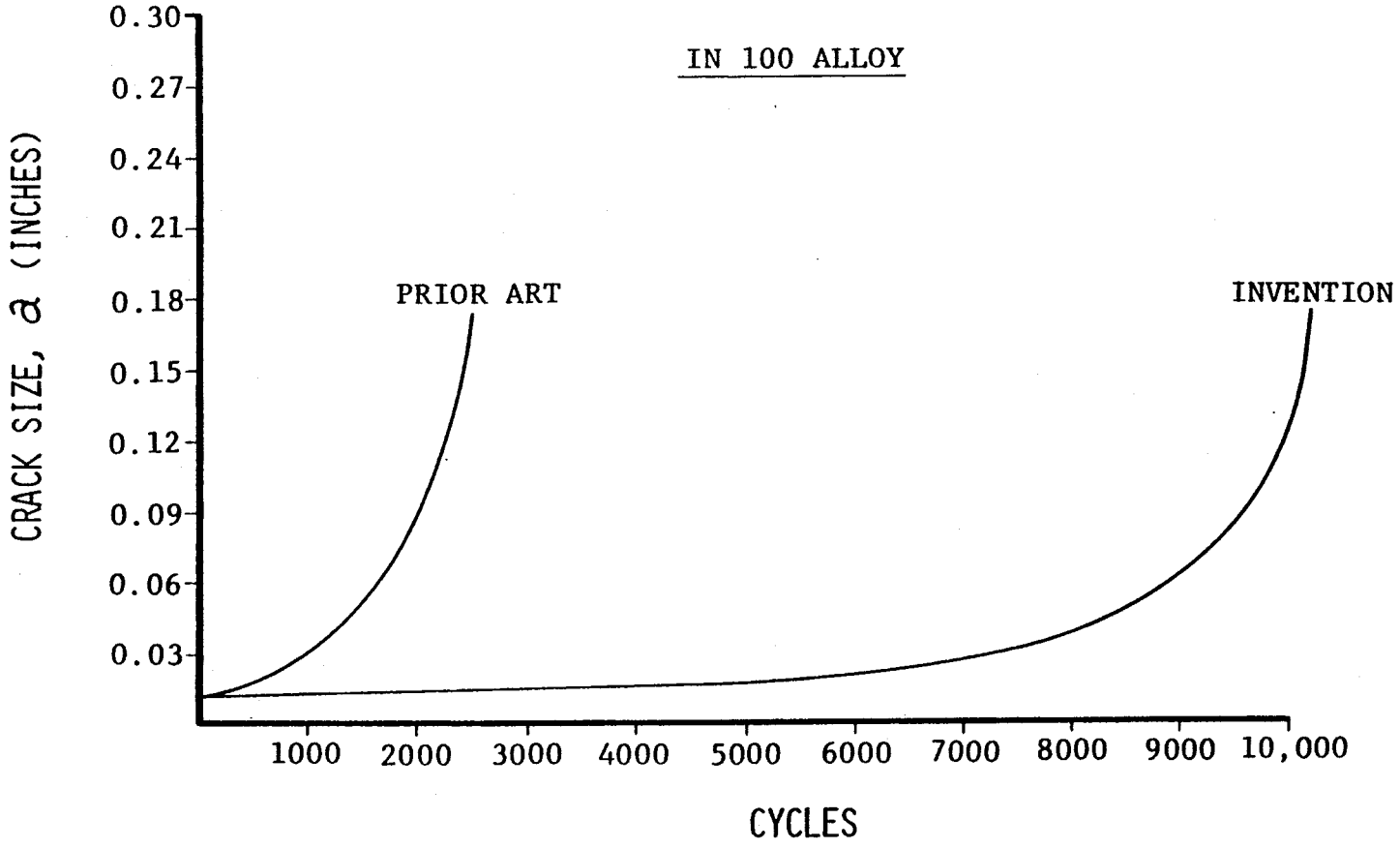
FIG. 2 shows a comparison between a standard heat treatment and a heat treatment according to the present invention applied to alloy IN-100 and specifically shows the crack size versus a number of cycles for tests performed at 1000° F. (538° C.) with an applied load of 130 ksi and a stress ratio, R=0.1 where $$R = \frac{\sigma_{min}}{\sigma_{max}}$$
Figure 3:
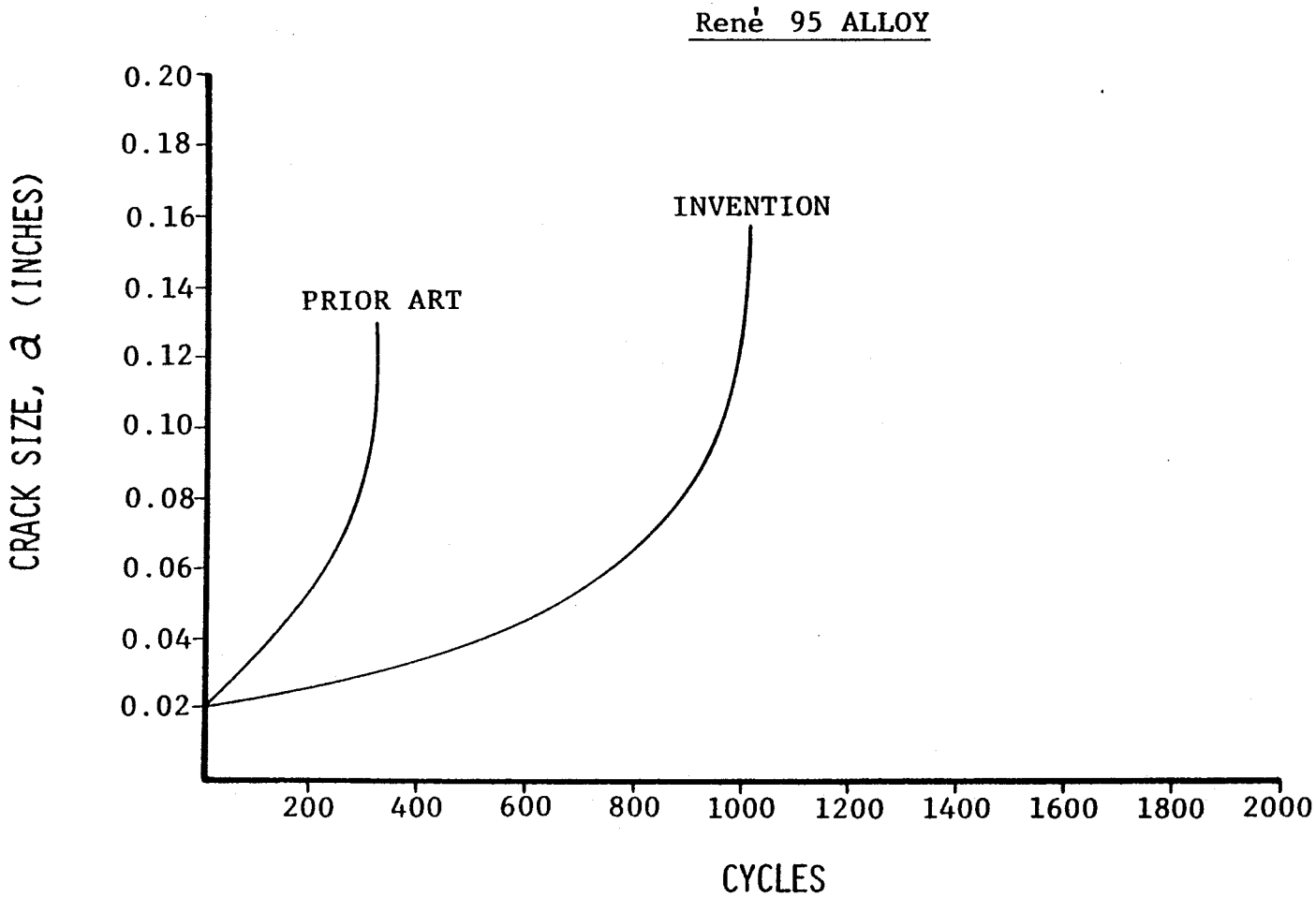

FIG. 3 shows data similar to that shown in FIG. 2 but for Rene 95 material (1200° F., 140 ksi 0.020×0.040 in. flaw, R=0.1).

BEST MODE FOR CARRYING OUT THE INVENTION

Figure 1:
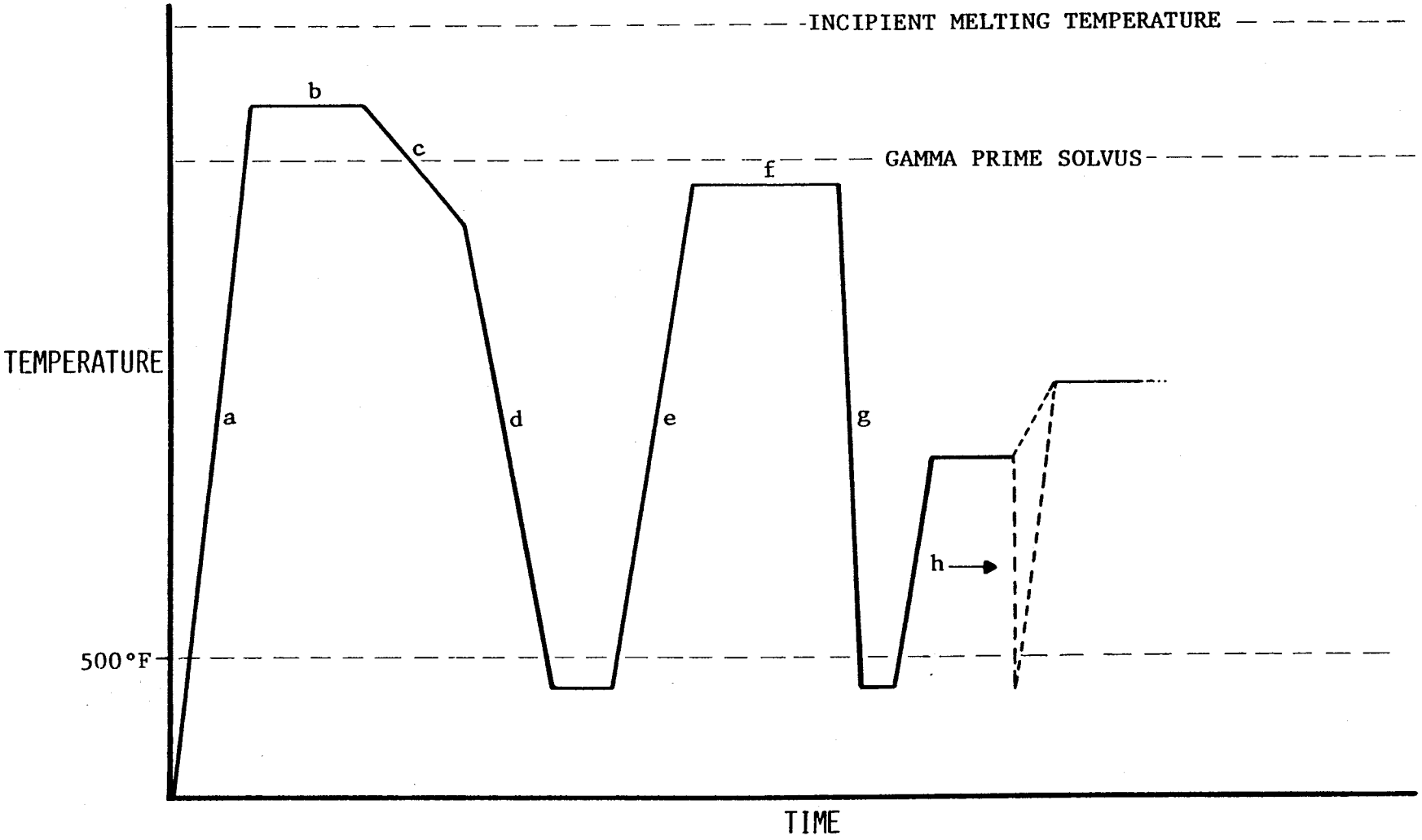
FIG. 1 schematically depicts the heat treatment process of the invention.

The invention is shown in schematic form in FIG. 1 which illustrates the various steps in the heat treatment and the relative temperatures and times employed. Table II sets forth broad and preferred ranges for the various parameters of the process shown in FIG. 1. Most of the temperatures presented in Table II are measured relative to the gamma prime solvus temperature.

The invention will be described using the broad ranges found in Table II, the parenthetical letters correspond to those in FIG. 1. The first step in the invention process is a (true) solution treatment. The significant parameters are: (a) the heat-up rate; (b) the treatment temperature and time; (c) the cooling rate in the vicinity of the gamma prime solvus temperature, and (d) the cooling rate at lower temperatures. The heat-up rate (a), especially in the vicinity of the gamma prime solvus temperature should be greater than 10° F. (5.6° C.) and preferably greater than 15° F. (8.3° C.) per minute. By exceeding this heat-up rate, exaggerated grain growth can be avoided. This value is not critical and the required rate can be achieved by placing the disk in a preheated furnace. The solution treatment (b) is performed at a temperature between the gamma prime solvus temperature and the incipient melting temperature for a time of from about 1 to about 10 hours. The article is cooled (c) from the solvus treatment temperature at a rate of 100° F. to 300° F. (501° C. to 167° C.) per minute to a temperature of from about 200° F. to 400° F. (111° C. to 222° C.) below the gamma prime solvus temperature. This procedure of a slow cooling the vicinity of the gamma prime solvus is essential to the success of the invention. It controls the grain boundary gamma prime morphology. Next, the article is cooled (d) to a temperature below 500° F. (260° C.), at a rate in excess of 100° F. (56° C.) per minute. This temperature is occasionally referred to as room temperature and is a temperature at and below which no significant microstructural changes occur in moderate time periods.

The next step in the invention process is a subsolvus (partial solution) heat treatment. For this treatment, the heat-up rate (e) is not critical, but again, the use of preheated furnace is indicated. The subsolvus holding temperature (f) should be 30° F. (17° C.) to 111° F. (93° C.) below the gamma prime solvus temperature. The treatment time (f) should range from about 1 to about 10 hours. The cooling rate (g) from this treatment temperature should be in the range of 100° F. (38° C.) to 500° F. (278° C.) per minute, and the article should be cooled to a temperature below 500° F. (260° C.).

The final step in the process is an aging step or steps (h). The aging should be performed at a temperature between 800° F. (427° C.) and 1600° F. (871° C.) for a total time of from about 5 to about 30 hours. Preferably, multiple aging steps are employed and, as shown in FIG. 1, the article can be cooled between the steps or can be transferred directly from one aging temperature to another. If multiple aging steps are used, they are preferably performed at a series of increasing temperatures, for example 1200° F. (649° C.) for 24 hours followed by 1400° F. (760° C.) for 4 hours. At least one aging step is preferably performed at a temperature which exceeds the maximum anticipated use temperature.

Table III presents the same information as presented in Table II for the specific alloys whose compositions were presented in Table I. The temperature in Table III are fixed temperatures, 5 rather than being relative to the gamma prime solvus temperature.

The result of this heat treatment process, as applied to the IN-100 alloy, is a rather coarse grain size combined with a distinctive triplex gamma prime size distribution. The average grain size in material treated according to the invention is 20–90 microns, (preferably 30–70 microns), in the prior art material, not given the true solution heat treatment, a typical grain size is 5–10 microns. Grain size appears to be essential to achieving improved crack growth behavior, but grain size alone is not sufficient; a coarse grain size must be accompanied by a particular gamma prime morphology. In material heat treated according to the invention, most of the gamma prime particles are found to be present in three size ranges. That is to say, a plot of number of particles (or percent of particles) versus particle size would produce a curve having three definite humps. Primary gamma prime particles having a typical size of 2–4 microns, (preferably 2–3 microns), 25 are found at the grain boundaries, while smaller particles whose typical size is either about 0.7 to 0.9 microns or less than 0.2 microns is found within the grains. On a volume percent basis, about 6% of the gamma prime occurs as (about) 2–4 micron particles, (preferably 2–3 microns), about 40% occurs as (about) 0.7 to 0.9 micron particles, and most of the balance occurs as 0.2 micron and smaller particles.

In IN-100, given typical prior art heat treatment, the gamma prime particles are found with a duplex size distribution of 0.8 to 1.6 microns. The precise relationship between the improved properties and gamma prime distribution is not understood.

The grain size and gamma prime distributions observed in Astroloy and Rene 95 material with conventional heat treatments and treated according to the invention are similar to those previously described with respect to IN-100.

EXAMPLE I

A gas turbine disk made of IN-100 alloy forged according to the process described in U.S. Pat. No. 3,519,503 was cut in half. One-half was given a conventional heat treatment consisting of a subsolvus treatment at 2065° F. (1129° C.) for 2 hours, oil quench, a stabilization treatment at 1600° F. (871° C.) for 40 minutes followed by air cooling; a second treatment at 1800° F. (982° C.) for 45 minutes followed by air cooling; and an aging heat treatment at 1200° F. (649° C.) for 24 hours, followed by a second treatment at 1400° F. (760° C.) for 4 hours. The other half of the disk was given the heat treatment of the invention according to the values given in Table III. Samples from the two disk halves were tested for crack growth performance at 1000° F. (538° C.) and 130 ksi nominal stress and R=0.1. The results are shown in FIG. 2 which presents the crack growth behavior of the two samples for an assumed surface flaw size of 0.012×0.024 inch (0.030×0.061 cm). The heat treatment of the invention is seen to provide a pronounced reduction in initial crack growth rate. For example, to reach a crack size of 0.05 inch (0.13 cm) in the prior art heat treatment material requires about 1600 cycles, which to reach the same crack size with material processed with the heat treatment of the present invention, requires about 8700 cycles. The reduction is about 440%, a substantial improvement which provides safer, more predictable behavior in the material.

Further testing was performed on the two disk halves with the following results. The yield strength at 1300° F. (740° C.) was found to be reduced by 15% through the use of the present invention process and the ultimate tensile strength was reduced by 5%. The room temperature yield strength was reduced by 16% and the ultimate tensile strength by 6%.

The ductility of the material (as measured by reduction in area) was increased by 71% at 1300° F. (704° C.) and by 12% at room temperature. The fatigue performance as measured on smooth samples tested at 1000° F. (538° C.) in a strain controlled test (1% total strain) was somewhat improved over the prior art heat treatment. Creep tests at 1000° F. (538° C.) show essentially equivalent behavior between the prior art process and the present invention process, while the stress rupture properties were improved by 250% through the use of the present process.

The crack growth behavior improvements of the invention process have been confirmed in testing on the Astroloy composition described in Table I.

In general, the invention process can be applied to most superalloys. For the purposes of this invention, superalloys may be defined as nickel solid solutions containing about 10–20% chromium, 2.5–6% aluminum, 1–5% titanium, 3–10% (Mo+W+Ta+Cb+Hf+V), 0.01–0.15% carbon, 0–0.03 boron, 0–0.1% zirconium. A more restricted. preferred disk composition is presented in Table I.

Thus, in summary, the invention process provides enhanced crack growth resistance, enhanced ductility, and enhanced stress rupture behavior with no debit in fatigue resistance. Yield and ultimate tensile strength are slightly reduced and creep behavior is unchanged.

EXAMPLE II

A gas turbine disk made of Rene 95 alloy (composition shown in Table I) was cut into sections. One section was given a conventional heat treatment consisting of incremental heating in a salt bath from a temperature of 800° F. to 2000° F. in a total period of 7½ hours, followed by a hold at 2000° F. in a salt bath for 50 minutes, followed by a hold in a salt bath at 2035° F. for 1 hour. The section was then quenched in a 1000° F. salt bath and held for 20 minutes, followed by a cooling to room temperature and then heating at 1400° F. for 8 hours followed by air cooling. This treatment is the treatment developed by the major user of the alloy and is apparently designed to provide optimum properties for gas turbine disk applications.

A second portion of the disk was given a heat treatment according to the present invention which consisted of heating to 2140° F. for 2 hours, followed by furnace cooling to 1900° F., followed by air cooling to room temperature, followed by 2035° F. for 2 hours, followed by forced air cooling to room temperature. The article was then aged at 1200° F. for 24 hours and air cooled and then aged 1400° F. for 4 hours and air cooled.

Samples of the two sections were tested for various mechanical properties, particularly crack growth behavior. FIG. 3 illustrates the crack growth behavior of the two sections. The data shown in FIG. 3 was obtained in a crack growth test performed at 140 ksi nominal stress, with R=0.1 and analyzed from an assumed starting surface flaw size of 0.02×0.040 in. Testing was performed at 1200° F. and the curves in FIG. 3 illustrate the resultant crack size as a function of stress cycles. The conventionally processed material had a crack size of about 0.1 inch after about 350 cycles whereas the sample process according to the present invention required about 950 cycles to reach the same crack size. Thus, the sample heat treatment according to the present invention required about 270% more cycles to achieve the same crack size as the conventionally heat treated sample. It should also be noted that the invention heat treatment applied in this example was one, within the invention, but not fully optimized, which clearly provided substantial benefits but there are undoubtedly further improvements to be obtained through further refinement of cycles for the particular alloy in question.

Other mechanical properties were also evaluated. In a tensile test at 1000° F. the invention processed material was about 15 ksi weaker than the conventionally processed material but the tensile ductility for material processed according to the invention process was better than that of the conventionally processed material. Stress rupture properties for the invention process material were better and creep properties were similar for the invention material as compared to the prior art process material. Low cycle fatigue was measured and in a stress controlled test cycling between 0 and 160 ksi results were slightly reduced whereas in a strained controlled material cycling between 0 and 1% strain the invention process material was similar to the prior art material.

Thus, in summary it can be seen that the invention process when applied to the Rene 95 composition produced a substantial reduction in crack growth rate and did not seriously compromise other mechanical properties.

Although this invention has been shown and described with respect to detailed embodiments thereof, it will be understood by those skilled in the art that various changes in form and detail thereof may be made without departing from the spirit and scope of the claimed invention.

TABLE I

TYPICAL SUPERALLOY CHEMICAL COMPOSITIONS*

| | Ni | Cr | Co | Ti | Al | Mo | C | V | Zr | B | Ta | Cb | Hf | W |
|---|---|---|---|---|---|---|---|---|---|---|---|---|---|---|
| Astroloy | Bal | 15.0 | 17.0 | 3.5 | 4.0 | 5.0 | 0.06 | — | — | 0.03 | — | — | — | — |
| IN-100 | Bal | 12.4 | 18.5 | 4.3 | 5.0 | 3.2 | 0.07 | 0.8 | 0.06 | 0.02 | — | — | — | — |
| René 95 | Bal | 14.0 | 8 | 2.5 | 3.5 | 3.5 | 0.15 | — | 0.05 | 0.01 | 3.5 | — | — | 3.5 |
| Broad | Bal | 12– | 8– | 2– | 3.2– | 2.8– | 0.010– | 0– | 0– | 0.005– | 0– | 0– | 0– | 0– |

TABLE I-continued

| TYPICAL SUPERALLOY CHEMICAL COMPOSITIONS* | | | | | | | | | | | | | |
|---|---|---|---|---|---|---|---|---|---|---|---|---|---|
| | Ni | Cr | Co | Ti | Al | Mo | C | V | Zr | B | Ta | Cb | Hf | W |
| Range | | 15.5 | 19 | 4.5 | 5.2 | 5.4 | 0.10 | 1 | 0.08 | 0.024 | 4 | 1.5 | 0.45 | 4 |

*weight percent

TABLE II

| | Broad | Preferred |
|---|---|---|
| a) heat-up rate (near GPS) | >10° F./min (11.1° C./min) | >15° F./min (8.3° C./min) |
| b) solution treatment temperature (relative to GPS) | between GPS and incipient melting temperature | between GPS and incipient melting temperature |
| solution treatment time | 1 to 10 hours | 1 to 5 hours |
| c) cooling rate to temperature (relative to GPS) | 100° F. to 300° F./hr (56° C. to 167° C./hr) to −200° F. to −400° F. (−111° C. to −222° C.) | 175° F. to 225° F./hr (97° C. to 125° C./hr) to −83° F. to −139° F. (−101° C. to −157° C.) |
| d) cooling rate to temperature | >100° F./min (56° C./min) to <500° F. (260° C.) | ≧150° F./min (83° C./min) to <350° F. (177° C.) |
| e) heat-up rate (sub-solvus) | not critical | not critical |
| f) holding temperature (relative to GPS) | −30° F. to −200° F. (−17° C. to −111° C.) | −50° F. to −100° F. (−28° C. to −56° C.) |
| holding time | 1 to 10 hours | 1 to 5 hours |
| g) cooling rate to temperature | >100° F./min (56° C./min) to <500° F. (260° C.) | >150° F./min (83° C./min) to <350° F. (177° C.) |
| h) age at | 800° F. to 1800° F. (427° C. to 982° C.) | 800° F. to 1800° F. (427° C. to 982° C.) |
| for | 3 to 5 hours | 5 to 30 hours in multiple steps with increasing temperatures |

TABLE III

| TYPICAL HEAT TREATMENTS |
|---|
| Astroloy |
| 2175° F. (1191° C.)/2 hr |
| furnace cool @ 200° F. (111° C.)/hr to |
| 1900° F. (1038° C.)/fan cool |
| 2050° F. (1121° C.)/4 hr/fan/cool + |
| 1200° F. (649° C.)/24 hr/air cool + |
| 1400° F. (760° C.)/8 hr/air cool |
| IN-100 |
| 2175° F. (1191° C.)/2 hr |
| furnace cool @ 200° F. (111° C.)/hr to |
| 1900° F. (1038° C.)/fan cool |
| 2065° F. (1129° C.)/2 hr/fan cool + |
| 1200° F. (649° C.)/24 hr/air cool + |
| 1400° F. (760° C.)/4 hr/air cool |
| René 95 |
| 2140° F. (1191° C.)/2 hr |
| furnace cool @ 200° F. (111° C.)/hr to |
| 1900° F. (1038° C.)/fan cool |
| 2035° F. (1129° C.)/2 hr/fan cool + |
| 1200° F. (649° C.)/24 hr/air cool + |
| 1400° F. (760° C.)/4 hr/air cool |

What is claimed is:

1. A heat treatment for reducing the crack growth rate in superalloy articles which consist essentially of 12-15.5% chromium, 8-19% cobalt, 2-4.5% titanium, 3.2-5.2% aluminum, 2.8-5.4% molybdenum, 0.01-0.1% carbon, 0-0.08% zirconium, 0.005-0.024% boron, 0-1% vanadium, 0-4% tantalum, 0-1.5% columbium, 0-0.45% hafnium, 0-4% tungsten, balance nickel, which consists of:

(a) solution treating the article at a temperature between the gamma prime solvus and the incipient melting temperature for a time of about 1 to 10 hours;

(b) cooling the article at a rate between about 100° F. (56° C.) and about 300° F. (167° C.) per hour to a temperature between about 200° F. (111° C.) and about 400° F. (222° C.) below the gamma prime solvus;

(c) cooling the article to below about 500° F. (260° C.) at a rate greater than about 100° F. (56° C.)/min;

(d) heating the article to a temperature about 30° F. (17° C.) to about 200° F. (111° C.) below the gamma prime solvus and holding at this temperature for about 1 to 10 hours;

(e) cooling the article to below about 500° F. (260° C.) at a rate in excess of about 100° F. (56° C.)/min; and (f) aging at one or more temperatures between about 800° F. (427° C.) and about 1800° F. (982° C.) for a total time of about 3 to 50 hours.

2. A heat treatment as in claim 1 wherein the superalloy has a nominal composition of about 12.4% chromium, 18.5% cobalt, 4.3% titanium, 5.0 aluminum, 3.2 molybdenum, 0.07 carbon, 0.8% vanadium, 0.06% zirconium, 0.02% boron, balance nickel.

3. A heat treatment as in claim 1 wherein the superalloy has a nominal composition of about 14.0% chromium, 8.0% cobalt, 2.5% titanium, 3.5% aluminum, 3.5% molybdenum, 0.15% carbon, 0.05% zirconium, 0.01% boron, 3.5% tantalum, 3.5% tungsten, balance nickel.

4. A heat treatment as in claim 1 wherein the superalloy has a nominal composition of about 15.0% chromium, 17.0% cobalt, 3.5% titanium, 4.0% aluminum, 5.0% molybdenum, 0.06% carbon, 0.03 boron, balance nickel.

5. A heat treatment as in claim 1 in which the cooling rate in step (b) is from about 150° F. (83° C.) to about 250° F. (139° C.)/hour.

6. A heat treated superalloy article consisting essentially of 12.4% chromium, 18.5% cobalt, 4.3% titanium, 5.0% aluminum, 3.2% molybdenum, 0.07% carbon, 0.8% vanadium, 0.06% zirconium, 0.02% boron, balance nickel, having a grain size of 20-90 microns, and containing a triplex distribution of gamma prime particles with about 6% by volume having a size of about 2-4 microns, about 40% by volume having a size of about 0.7-0.9 microns and about 54% by volume having a size of less than about 0.2 micron.

7. A superalloy article heat treated according to claim 1.

* * * * *